United States Patent [19]

Denis et al.

[11] Patent Number: 4,976,746

[45] Date of Patent: Dec. 11, 1990

[54] FORMULATIONS OF NITROGENATED ADDITIVES FOR ENGINE FUELS AND THE ENGINE FUELS CONTAINING THEM

[75] Inventors: Jacques Denis, Charbonniere les Bains; Xavier Montagne, Paris; Philippe Mulard, Saint Pierre de Chandieu; Danièle Eber, Lyons, all of France

[73] Assignee: Institut Francais du Petrole, Rueil Malmaison, France

[21] Appl. No.: 372,598

[22] Filed: Jun. 28, 1989

[30] Foreign Application Priority Data

Jun. 29, 1988 [FR] France ..... 88 08900

[51] Int. Cl.[5] ..... C10L 1/22; C10L 10/02; C10L 10/04

[52] U.S. Cl. ..... 44/330; 44/331; 44/386

[58] Field of Search ..... 44/73, 63

[56] References Cited

U.S. PATENT DOCUMENTS

| | | | |
|---|---|---|---|
| 2,568,876 | 11/1949 | White | 44/63 |
| 3,138,610 | 6/1964 | Bug | 44/63 |
| 3,172,892 | 3/1965 | LeSuer | 252/51.5 A |
| 3,312,619 | 4/1967 | Vineyard | 252/51.5 A |
| 4,189,389 | 1/1979 | Soula | 252/51.5 A |
| 4,247,300 | 1/1981 | Bonazza | 44/63 |
| 4,422,856 | 12/1983 | Maldonado | 44/63 |

FOREIGN PATENT DOCUMENTS

| | | | |
|---|---|---|---|
| 985373 | 11/1963 | United Kingdom | 252/51.5 A |
| 074724 | 3/1983 | United Kingdom . | |

*Primary Examiner*—Olik Chaudhuri
*Assistant Examiner*—Rhonda R. Brown
*Attorney, Agent, or Firm*—Millen, White & Zelano

[57] ABSTRACT

Formulations of additives for engine fuels comprising at least one constituent (A) and one constituent (B) resulting from the reaction of at least one alkenyl or polyalkenyl-succinic derivative with at least one polyamine to form constituent (A) and with at least one 1-(2-hydroethyl) imidazoline substituted in the 2-position by a linear or branched alkyl or alkenyl radical with 1 to 25 atoms of carbon to form constituent (B). The preferred formulations also contain a constituent (C) consisting of at least one polyglycol soluble in said fuel, with an average molecular mass ranging from 480 to 2,100. The (A)/(B) and (A)+(B)/(C) molar ratios preferably are respectively 0.2/1 to 5/1 and 0.05/1 and 20/1.

14 Claims, No Drawings

FORMULATIONS OF NITROGENATED ADDITIVES FOR ENGINE FUELS AND THE ENGINE FUELS CONTAINING THEM

BACKGROUND OF THE INVENTION

The present invention relates to formulations of additives which, added for example to engine fuels, substantially reduce the tendency of the latter to form deposits and to corrode various parts of the engine.

The use of conventional fuels very often leads to the fouling of the various engine parts, due to the incomplete vaporization and combustion of the fuel in the inlet system and/or in the combustion chamber and to the presence of lubricant traces.

In the inlet system, the accumulation of these deposits can thus occur at the level of the injectors, the carburetor and the inlet valves.

Such an accumulation has harmful consequences on the level of the driving pleasure, with the appearance of an unsteady idling and misfires in spark ignition engines, as well as on the level of the optimum running of the engine through the modification of the fuel-air ratio owing to the adsorption-desorption phenomena of the fuel on the formed deposits.

In order to remedy this fouling, it is possible to carry out a periodic cleaning of the affected parts, especially the valves, which is particularly costly.

The accumulation of deposits in engines and particularly on inlet valves can also be reduced by using fuels which contain certain additives, for example detergent-type additives that are possibly combined with, for example, anticorrosive or antideposition additives for combustion chambers.

Additives, which are well-known in the trade, for example those of the polyisobutene-amine type, are usually associated with a mineral or a synthetic oil and may lead to an increasing fouling of the combustion chambers and thus to an increase in the octane requirement of the engine, with a higher sensitivity to knocks.

Among the numerous additives described in the prior art, the products of the condensation of polyalkenylsuccinic anhydrides on polyamines, such as for example tetraethylenepentamine, which are particularly described in U.S. Pat. No. 3,172,892, can be cited. These additives show good results as far as anticorrosive properties are concerned, but they are not efficient as valve detergents.

One can also cite the products of the condensation of polyalkenylsuccinic anhydrides on hydroxyimidazolines, and particularly on 1-(2-hydroxyethyl) imidazolines substituted in position 2 by an alkyl or an alkenyl group, such as those which are described in patent application EP-A-74,724. The products described in this application are good additives for engine fuels and their anticorrosive action is considerable, but they are not very efficient at the level of the carburetor detergency.

Most commercial additives are mostly used in association with a mineral oil the main function of which is to increase or obtain the necessary "valve" detergency.

The use of a mineral oil usually causes a relatively considerable fouling of the combustion chamber, which is harmful to the good running of the engine. The viscosity of the additive concentrate obtained by adding the mineral oil is usually relatively high, which may cause difficulties as far as material handling and additivation (addition of additive to the fuel) are concerned.

Besides, the additive concentrates comprising a mineral oil show a bad cold-resistance.

DESCRIPTION OF THE INVENTION

The invention involves formulations of additives which, notably for engine fuels, allow substantially reducing the disadvantages cited above. The additive formulations of the present invention can notably be utilized as multifunction additives for fuels, particularly for the fuels used in spark ignition engines.

The additive formulations of the invention show excellent detergency properties at the level of the inlet valves and the carburetor, as well as very good anticorrosive properties. The additive formulations of the invention, which are particularly used in fuels for spark ignition engines, allow highly reducing the forming of deposits on the inlet valves, as well as the fouling of carburetors or injectors.

Further, these additive formulations decrease the corrosion of the various mechanical parts that are contacted by the fuel.

These additive formulations can be used without any mineral oil addition, which allows avoiding the drawbacks mentioned above, linked to the use of a mineral oil.

In a general way, these additive formulations, notably for engine fuels, comprise:

One constituent (A) and one constituent (B), said constituent (A) consisting of at least one nitrogen compound resulting from the reaction of at least one succinic derivative, selected from the group constituted by the alkenylsuccinic acids and anhydrides and the polyalkenylsuccinic acids and anhydrides, on at least one polyamine corresponding to the general formula:

$$R^1-Z-[-(\overset{R_2}{\overset{|}{C}}H-)_n-NH]_m-H \text{ or} \qquad (I)$$

$$\begin{matrix} R^1 \\ R^3 \end{matrix}\!\!>N-A-(O-B)_a-(O-C)_b-(O-D)_c-NH_2 \qquad (II)$$

where $R^1$ represents an atom of hydrogen or a hydrocarbon group with 1 to 60 atoms of carbon, Z is selected among groups —O—and $NR^3$ in which $R^3$ represents an atom of hydrogen or a hydrocarbon group with 1 to 60 atoms of carbon, $R^1$ and $R^3$ can form together with the atom of nitrogen to which they are linked a heterocyclic compound, each $R^2$ independantly represents an atom of hydrogen or a hydrocarbon group with 1 to 4 atoms of carbon, n is an integral number from 2 to 6, m is an integral number from 1 to 10 when Z is $NR^3$ and an integral number from 2 to 10 when Z is —O—, A, B, C and D, identical or different, represent each a divalent hydrocarbon group with 2 to 6 atoms of carbon, a is an integral number from 1 to 120 and most often from 1 to 60, b and c, identical or different, are each zero or an integral number from 1 to 50 and the sum a+b+c is an integral number from 1 to 120 and most often from 1 to 60 and said constituent (B) consisting of at least one nitrogen compound resulting from the reaction of at least one succinic derivative selected from the group constituted by the alkenylsuccinic acids and anhydrides and the polyalkenylsuccinic acids and anhydrides on at least one 1-(2-hydroxyethyl)-imidazoline substituted in position 2 by a linear or branched alkyl or alkenyl radical with 1 to 25 atoms of carbon.

In a preferred embodiment, the additive formulations according to the present invention also contain at least one constituent (C) consisting of at least one polyglycol soluble in said fuel, with a molecular mass ranging from 480 to 2,100 and of the general formula (III):

$$HO—R—(—O—R—)_x—O—R—OH \quad (III)$$

in which each group R independantly represents a hydrocarbon group with 2 to 6 atoms of carbon and x represents the average polymerization degree.

In the formulations according to the present invention, constituent (C) is preferably a polyglycol of general formula (III) cited above, in which each group R independantly represents a linear or branched alkylene group with 2 to 4 atoms and carbon and most often an ethylene or propylene group. Among the particularly preferred polyglycols of the general formula (III), those in which each group R represents a propylene of the following formula can be cited:

$$CH_3—CH—CH_2—$$

Constituent (C) is preferably a polyglycol with an average molecular mass ranging from 600 to 1,800 and most often from 650 to 1,250. The polydispersivity number of the polyglycol used as constituent (C) in the formulations according to the present invention usually ranges from about 1 to 1.25 and most often from about 1 to 1.15.

One of the characteristics of the invention relates to the synergistic effect which can be observed when constituent (A) and constituent (B) are associated in a fuel. This synergy notably shows through the substantial decrease of the fuel tendency to form deposits on the inlet valves; such a considerable decrease could not be expected in view of the separate effects of constituents (A) and (B). This synergy also shows through a notable improvement of the carburetor cleanliness after a determined running duration, an improvement which could not be expected in view of the separate effects of constituents (A) and (B).

This synergistic effect can also be observed when constituent (C) is associated with constituents (A) and (B) cited above.

In the formulations of the invention containing both constituents (A) and (B), in order to obtain a particularly strong reduction of the forming of deposits, it is advantageous to have the molar ratio of constituent (A) to constituent (B) ranging from 0.2:1 to 5:1, preferably from 0.2:1 to 1:1, more preferably from 0.3:1 to 0.9:1 and, even better, from 0.4:1 to 0.8:1.

In the case of formulations according to the present invention containing the three constituents (A), (B) and (C), it is advantageous, in order to obtain a higher reduction of the formed deposits, to have the molar ratio of the sum of the moles of constituent (A) and constituent (B) to the number of moles of constituent (C), ((A)+(B))/(C), ranging from about 0.05:1 to 20:1 and preferably from about 0.1:1 to 10:1; the molar ratio of constituent (A) to constituent (B) remains within the ranges mentioned above.

The succinic acid and/or anhydride used for forming constituent (A) and constituent (B) can be identical or different. It is possible to use only one succinic derivative or a mixture of succinic derivatives.

The succinic acid and/or anhydride utilized within the scope of the present invention usually has an average molecular mass ranging from about 200 to 3,000, preferably from 500 to 2,000 and most often from 700 to 1,500. These succinic derivatives are largely described in prior art; they are for example obtained through the reaction of at least one alpha olefin or one chlorinated hydrocarbon with maleic acid or anhydride. The alpha olefin or the chlorinated hydrocarbon which is used in this synthesis can be linear or branched, and they usually comprise 10 to 150 atoms of carbon, preferably 15 to 80 atoms of carbon and most often 20 to 75 atoms of carbon in their molecule. This olefin can also be an oligomer, for example a dimer, a trimer or a tetramer, or a polymer with an olefin with a shorter chain, with for example 2 to 10 atoms of carbon, such as ethylene, propylene, 1-butene-n, isobutene, 1-hexene-n, 1-octene-n, methyl-2-heptene-1 or methyl-2-propyl-5-hexene-1. It is possible to utilize mixtures of olefins or of chlorinated hydrocarbons.

As an example of succinic anhydrides, n-octadekenylsuccinic anhydride, dodekenylsuccinic anhydride and the polyisobutenylsuccinic anhydrides, which are often called PIBSA, with an average molecular mass such as that defined above, can be cited.

The polyamines of formula (I) are preferably those in which $R^1$ is an atom of hydrogen or a hydrocarbon group with 1 to 30 atoms of carbon, Z is preferably a $NR^3$ group in which $R^3$ preferably represents an atom of hydrogen or a hydrocarbon group with 1 to 30 atoms of carbon, each $R^2$ independantly preferably represents an atom of hydrogen or a methyl group, n is an integral number ranging from 2 to 4 when Z is a $NR^3$ group, m preferably is an integral number from 1 to 5.

Among the compounds of formula (I) cited above, it will be advantageous to use those in which Z is $NR^3$, $R^1$, $R^2$, and $R^3$ represent each an atom of hydrogen, n is equal to 2 and m is an integral number from 1 to 5 or those in which $R^1$ represents a hydrocarbon group with represents a $NR^3$ group in which $NR^3$ is an atom of hydrogen, $R^2$ represents an atom of hydrogen, n is an integral number from 2 to 4, preferably 3, and m is an integral number from 1 to 5, preferably 1.

The hydrocarbon groups $R^1$ and $R^3$ are usually alkyl, alkenyl groups, linear or branched, aryl, aryl-alkyl (aralkyl), alkyl-aryl (alkaryl) or cyclo-aliphatic groups. Groups $R^1$ and $R^3$ are preferably alkyl or alkenyl groups, linear or branched. The hydrocarbon group $R^2$ is usually an alkyl group, preferably linear, and for example methyl, ethyl, n-propyl or n-butyl.

The following specific compounds can be cited: ethylenediamine, propylenediamine, triethylenetetramine, tripropylenetetramine, tetraethylene pentamine, trimethylenediamine, hexamethylenediamine, di(trimethylene)triamine, the N-alkyl diamino-1,3 propane, for example N-dodecycldiamino-1,3 propane , N-tetradecyldiamino-1,3 propane, N-hexodecyldiamino-1,3 propane, N-octadecyldiamino-1,3 propane; the N-alkyldipropylene triamines can also be cited, for example N-hexadekyldipropylene triamine, N-octadecyldiamino triamine, N-eicosyldipropylene triamine and N-docosyldipropylene triamine; the n-alkenyldiamion-1,3 propane and the N-alkenyldipropylene triamines can also be cited, for example N-octadecyldiamino-1,3 propane, N-hexadecynyldiamino-1,3 propane, N-dodecylenyldiamion-1,3 propane, N-octadecadienyldiamino-1,3 propane and N-docosenyldiamino-1,3 propane. The following disubstituted N,N diamines can be cited: N,N-diethyl diamino-1,2 ethane, N,N-diisopropyl diamino-1,2 ethane, N,N-dibutyl diamino-1,2 ethane, N,N-diethyl diamino-1,4 butane, N,N-dimethyl diamino-1,3 propane, N,N-diethyl diamino-1,3 propane, N,N-dioctyl diamino-1,3 propane, N,N-didecyl diamino-1,3 propane, N,N-didodecyl diamion-1,3 propane, N,N-ditetradecyl diamino-1,3 propane, N,N-dihexadecyl diamino-1,3 propane, N,N-diotadecyl diamino-1,3 propane, N,N-didodecyldipropylene triamine, N,N-ditetradekyldipropylene triamine, N,N-dihexadecyldipropylene triamine, N,N-dioctadecyldidpropylene triamine, the N-methyl, N-butyl diamino-1,2 ethane, N-methyl, N-octyl diamino-1,2 ethane, N-ethyl, N-octyl diamino-1,2 ethane, N-methyl, N-decyl diamino-1,2 ethane, the N-methyl, N-dodecyl diamino-1,3 propane N-methyl, N-hexadecyl diamino-1,3 propane and N-ethyl, N-octadecyl diamino-1,3 propane.

As an example of etheramines, N-(octyloxy-3-propyl)diamino-1,3 propane, N-decyloxy-3 propyl)-diamino-1,3 propane, N-(trimethyl-2,4,6 decyl)oxy-3 propyl diamino-1,3 propane can be cited.

It must be agreed that it is possible to utilize as a polyamine compound one or several compounds corresponding to formula (I) and/or (II). As specific examples of compound mixtures corresponding to formula (I), the following can be cited:

The cuts of fatty diamines corresponding to the formula $R^1$—NH—$(CH_2)_3NH_2$ the $R^1$ groups of which are aliphatic hydrocarbon radicals with $C_8$, $C_{10}$, $C_{12}$, $C_{14}$, $C_{16}$; $C_{18}$, $C_{20}$ and $C_{22}$, with the approximate molar proportions given in Table I hereafter.

TABLE I

| | alkyl chains | | | | | | | | |
|---|---|---|---|---|---|---|---|---|---|
| Cuts | $C_8$ | $C_{10}$ | $C_{12}$ | $C_{14}$ | $C_{16}$ | $C_{18}$ | $C_{18-1}$* | $C_{20}$ | $C_{22}$ |
| A | 0 | 0 | 0 | 1% | 28% | 71% | 0 | 0 | 0 |
| B | 0 | 0 | 0 | 1% | 5% | 42% | 0 | 12% | 40% |
| C | 3% | 6% | 56% | 18% | 10% | 2% | 5% | 0 | 0 |
| D | 0 | 0 | 0 | 0 | 16% | 4.9% | 79.1% | 0 | 0 |
| E | 0 | 0 | 0 | 2.3% | 31.8% | 24.2% | 39% | 2.7% | 0 |

*$C_{18-1}$ chain with an ethylenic unsaturation.

The polyamines of formula (II) are preferably those in which $R^1$ and $R^3$ represent each an atom of hydrogen, A, B, C and D, identical or different, represent each an alkylidene group with 2 to 4 atoms of carbon, for example ethylidene, propylidene, isopropylidene, butylidene and isobutylidene, a is an integral number from 1 to 60 and b and c are equal to zero; or a is an integral number from 1 to 59, c is zero or an integral number so that the sum a+c ranges from 1 to 59 and b is an integral number from 1 to 50; with, in each case, the sum a+b+c equal to an integral number from 1 to 60.

As specific compounds of formula (II), those corresponding to the following formulas can be cited:

$$NH_2-CH_2CH_2-(O-CH_2-CH_2)_a-NH_2 \quad (II_1)$$

$$NH_2-\underset{\underset{CH_3}{|}}{CH}-CH_2-(OCH_2-\underset{\underset{CH_3}{|}}{CH})_a-NH_2 \quad (II_2)$$

in which a is 2, 3, 5, 6 or about 33

$$NH_2-\underset{\underset{CH_3}{|}}{CH}-CH_2-(O\underset{\underset{CH_3}{|}}{CH}-CH_2-)_a(OCH_2CH_2)_b(O-CH_2\underset{\underset{CH^3}{|}}{CH}-)_cNH_2 \quad (II_3)$$

in which b is equal to about 8, 9, 15, 16 or 40 and a+c is about 2 or 3.

These products are particularly marketed by the TEXACO Chemical company under the trademark Jeffamine EDR 148 for the product of formula ($II_1$) in which a=2, Jeffamine D-230 for a product of formula ($II_2$) with an average molecular mass of 230, Jeffamine D-400 for a product of formula ($II_2$) with an average molecular mass of 400, Jeffamine D-2000 for a product of formula ($II_2$) with an average molecular mass of 2,000, Jeffamine ED-600 for a product of formula ($II_3$) with an average molecular mass of 600, Jeffamine ED-900 for a product of formula ($II_3$) with an average molecular mass of 900 and Jeffamine ED-2001 for a product of formula ($II_3$) with an average molecular mass of 2,000.

The formation reaction of constituent (A) is usually performed by progressively adding the polyamine to a solution or a dispersion of the succinic derivative in an organic solvent, at an ordinary temperature, and then by heating up to a temperature usually ranging from 65° to 250° C., preferably from 80° to 200° C.

The organic solvent that is utilized in this preparation, the boiling point of which ranges from 65° to 250° C., is usually selected in order to be able to allow the removal of the water formed during the condensation of the polyamine on the succinic derivative, preferably in the form of a water-organic solvent azeotrope. The organic solvent which is usually chosen is for example benzene, toluene, xylenes, ethylbenzene or a hydrocarbon cut such as the SOLVESSO 150 (190°-209° C.) commercial cut containing 99% by weight of aromatic compounds.

It is possible to use mixtures of solvents, for example a mixture of xylenes. The heating time after the end of the polyamine addition usually ranges from 0.5 to 7 hours, preferably from 1 to 5 hours.

The heating is usually carried on, at the chosen temperature, most often under refluxing, until the end of the removal of the water formed during the reaction. The obtained product is then possibly isolated by removing, for example through vacuum distillation, the solvent used in the preparation. The amount of water removed during the reaction usually ranges from about 0.8 to 1.2 mole and is most often about 1 mole of water per mole of succinic derivative.

The polyamine is preferably diluted in an organic solvent, for example one of those cited above, and preferably the same as that which has been used for forming the solution or the dispersion of the succinic derivative; this dilution facilitates the progressive addition of the polyamine. The amount of polyamine which is usually utilized is about at least 0.5 mole per mole of succinic derivative, for example 0.5:1 to 2:1 and preferably 0.8:1 to 1.2:1. An amount of about 1 mole of polyamine per mole of succinic derivative is used most often. The constituent (A) which is used can be a commerical compound, for example the compound sold by the OCTEL company under the reference OMA 410G, which has for base a product of the condensation of the tetraethylene pentamine on a PIBSA.

The 1-(2-hydroxyethyl-)-imidazolines substituted in position 2 by an alkyl or alkenyl radical with 1 to 25 atoms of carbon, which are utilized for preparing constituent (B), can be commercial compounds or they can be synthesized for example by the reaction of at least one organic acid with the N-(2-hydroxyethyl)ethylenediamine. The reaction starts with a first amidation stage, followed by a cyclization. The organic acids that are used usually have 2 to 26 atoms of carbon; they preferably are monocarboxylic aliphatic acids. As an example, acetic acid, propanoic acid, butanoic acid, caproic acid, capric acid, lauric acid, myristic acid, palmitic acid, stearic acid, behenic acid, cerotic acid and the following unsaturate fatty acids can be cited:

| | |
|---|---|
| $CH_3—CH_2—CH=CH—(CH_2)_7COOH$ | dodekylenic acid |
| $CH_3—(CH_2—)_5CH=CH—(CH_2—)_7COOH$ | palmitoleic acid |
| $CH_3—(CH_2—)_7CH=CH—(CH_2—)_7COOH$ | oleic acid |
| $CH_3—(CH_2—)_5CHOH—CH_2—CH=CH—(CH_2—)_7COOH$ | ricinoleic acid |
| $CH_3—(CH_2—)_{10}CH=CH—(CH_2—)_4COOH$ | petroselenic acid |
| $CH_3—(CH_2—)_5CH=CH—(CH_2—)_9COOH$ | vaccenic acid |
| $CH_3—(CH_2—)_4CH=CH—CH_2—CH=CH—(CH_2—)_7COOH$ | linoleic acid |
| $CH_3—(CH_2—)_9CH=CH—(CH_2—)_7COOH$ | gadoleic acid |
| $CH_3—(CH_2—)_9CH=CH—(CH_2—)_9COOH$ | ketoleic acid |
| $CH_3—(CH_2—)_7CH=CH—(CH_2—)_{11}COOH$ | erucic acid |
| $CH_3—(CH_2—)_7CH=CH—(CH_2—)_{13}COOH$ | selacholeic acid |

1-(2-hydroxyethyl)-2-heptadekenyl imidazolinie, prepared for example from oleic acid and N-(2-hydroxyethyl)-ethylenediamine, will for example be used. This preparation is for example described in U.S. Pat. No. 2,987,515.

The example of 1-(2-hydroxyethyl)-2-methyl imidazoline prepared for example from acetic acid and N-(2-hydroxyethyl-)ethylenediamine, can also be cited.

1-(2-hydroxyethyl)-2-heptadekenyl imidazoline is marketed by the CIBA-GEIGY company under the name "Amine-O" and by the PROTEX company under the name "Imidazoline-O".

The preparation of constituent (B) is usually performed by progressively adding imidazoline for example diluted in an organic solvent to a solution or a dispersion of the succinic derivative in an organic solvent. The solvents that are used are preferably identical and they are for example chosen among those cited above, in the description of the preparation of constituent (A).

The addition of the imidazoline to the succinic derivative is usually carried out at room temperature; after the end of the addition, the temperature is brought up to about 65° to 250° C., preferably about 80° to 200° C. The heating time after the end of the imidazoline addition usually ranges from 0.5 to 7 hours, preferably from 1 to 5 hours. The heating is usually carried on, at the chosen temperature, most often under refluxing, until the end of the removal of the water formed during the reaction.

The obtained product is then possibly isolated by removing, for examples by vacuum distillation, the solvent used in the preparation. The amount of water removed during the reaction usually ranges from about 0.2 to 0.8 mole and most often from about 0.3 to 0.6 mole of water per mole of succinic derivative. The amount of imidazoline utilized during the reaction is usually at least 0.5 mole per mole of succinic derivative, for example 0.5:1 to 1.5:1 and preferably 0.9:1 to 1.1:1. An amount of about 1 mole of imidazoline per mole of succinic derivative is used most often. The formulations of the present invention can be used in the form of a solution in the reaction medium which has served for preparing each constituent.

The formulations can also be added directly into the fuel or be previously diluted in a solvent selected for example among these mentioned above for the preparation of each constituent.

The formulations of the present invention are mainly used as multifunction additives for an engine fuel, for example a fuel having for base hydrocarbons or a mixture of hydrocarbons and at least one oxygen compound selected among the group constituted by alcohols and ethers, or a non-hydrocarbon fuel such as for example an alcohol or a mixture of alcohols.

The formulations of the present invention are particularly well adapted for being used as additives for fuels utilized in spark ignition engines.

As an example of fuels, gasolines such as for example those defined by the D-439 ASTM standard, gas-oils or Diesel fuels such as, for example, those defined by the D-975 ASTM standard, can be cited. These fuels may also contain additives other than the formulations of the present invention, for example antiknock additives such as lead compounds(for example tetraethyl lead), methyltertiobutylether, methyltertioamylether or a mixture of methanol and tertiobutyl alcohol, antifreezing additives and octane number reducers.

The formulations of the present invention are utilized in an amount which is sufficient for obtaining a considerable decrease of the deposits on the various parts of the engine, particularly at the level of the inlet valves and the carburetor. Amounts representing 10 to 3,000 ppm by weight of active material in relation to the weight of the fuel, preferably 10 to 1,000 ppm and most often 50 to 700 ppm, are usually utilized. In the formulations according to the present invention containing the three constituents (A), (B) and (C), the amount of constituent (C) usually ranges from 10 to 2,000 ppm, most often from 10 to 900 ppm and preferably from 30 to 800 ppm.

The following examples illustrate the invention without limiting the scope thereof. Examples 1 to 5 describe the preparation of constituents (A) and (B) which are used for preparing formulations according to the invention.

EXAMPLE 1

408 g (0.40 mole) of polyisobutenylsuccinic anhydride (PIBSA) resulting from the condensation of polyisobuten (polyisobutene with an average molecular mass of 920) on maleic anhydride (the quantitative analysis of the anhydride functions of this product shows a 0.7 anhydride function per theoratical mole of PIBSA) and 408 g of xylene are charged into a 2 liter-reactor equipped with a mechanical stirring device, a Dean-Stark apparatus and a temperature regulation system.

145 g (0.41 mole) of 1-(2-hydroxyethyl)-2-heptadekenyl imidazoline diluted in 143 g of xylene are then added drop by drop at room temperature and under stirring. The addition is carried out within 30 minutes, under a fast increase of the temperature of the reaction mixture by about 5° C.

The mixture is then brought to refluxing for 3 hours while the reaction water is removed by azeotropic distillation. The amount of collected water is 2.3 ml. The advance of the reaction can also be followed by infrared spectrometry at the level of the absorption band of the imine function at 1,660 $cm^{-1}$ which progressively disappears during the reaction, while two bands (1,710 $cm^{-1}$ and 1,770 $cm^{-1}$) characteristic of the succinimide function appear.

A solution of 50% by weight of active material, in the xylene, of constituent B1, is thus obtained.

EXAMPLE 2

15.6 g (0.15 mole) of N-hydroxyethylethylenediamine diluted in 15.6 g of toluene are introduced into a 2 liter-reactor equipped with a mechanical stirring device, a Dean-Stark apparatus and a temperature regulation system. 9 g (0.15 mole) of glacial acetic acid diluted in 9 g of toluene are then progressively added (drop by drop). The mixture is then brought to refluxing for 16 hours during which 4.8 ml of water are removed by azeotropic distillation. The product of the reaction is isolated after the vacuum evaporation of the toluene. A pale yellow oily product which has been characterized by conventional analysis means as 1-(2-hydroxyethyl)-2-methyl imidazoline is thus obtained.

The infrared spectrum shows an imine band at 1,660 $cm^{-1}$ and, by means of nuclear magnetic resonance spectrometry, it is possible to determine the presence of the two methylene groups of the imidazoline cycle and the presence of the methyl group in position 2 on the imidazoline cycle.

The elementary ultimate analysis shows a nitrogen content of 22.1% by weight for a calculated percentage of 21.8%.

The procedure described in example 1 is repeated while replacing the 1-(2-hydroxyethyl)-2-heptadekenylimidazoline by the 1-(2-hydroxyethyl)-2-methlimidazoline prepared above. 122.4 g (0.12 mole) of PIBSA diluted in 122.4 g of xylene and 6.1 g (0.048 mole) of imidazoline prepared as described above and diluted in 5 g of xylene have been used. The refluxing is maintained for 3 hours and 0.9 ml of water is removed.

A solution of 50% by weight of active material, in the xylene, of constituent B2, is thus obtained.

EXAMPLE 3

The procedure described in example 1 is repeated while replacing the imidazoline by a tallow diamine such as that which is marketed by the CECA company under the name Dinoram S and which corresponds to cut E the characteristics of which have been mentioned in Table I above.

306 g (0.3 mole) of PIBSA diluted in 306 g of xylene and 108 g (0.3 mole) of Dinoram S diluted in 108 g of xylene are used. The refluxing is maintained for 5 hours. The reaction water is removed as it forms; this removal essentially occurs during the first 4 hours of the reaction. A solution of 50% by weight of active material, in the xylene, of constituent A2, is thus obtained.

EXAMPLE 4

The procedure described in example 3 is repeated while replacing the Dinoram S by 0.3 mole of tetraethylenepentamine (56 g) diluted in 56 g of xylene. The refluxing is maintained for 5 hours. The reaction water is removed as it forms; this removal essentially occurs during the first 4 hours of the reaction. A solution of 50% by weight of active material, in the xylene, of constituent A3, is thus obtained.

EXAMPLE 5

The procedure described in example 1 is repeated while replacing the imidazoline by the polyoxyalkyleneamine marketed by the TEXACO company under the name Jeffamine D-400, with an average molecular mass of 400. The Jeffamine D-400 is added in the form of a solution in the xylene containing 164 g (0.41 mole) of Jeffamine D-400. The refluxing is maintained for the total duration of the reaction water removal by azeotropic distillation, and then for one more hour. A solution of 50% by weight of active material, in the xylene, of constituent A4, is thus obtained.

EXAMPLE 6

A Renault 11 GTL has been used to show the effect of the formulations according to the invention on the tendency of the fuels to form deposits on the inlet valves. The tests have been carried out through preventive-type treatments on a 5,000 km-run. The fuel which is utilized is a conventional supergasoline to which a lead alkyl additive of 0.4 g of lead/liter (base fuel) has been added.

This supergasoline comprises by volume:

48.1% of paraffins
15.4% of olefins
29.2% of aromatics
4.3% of naphthenics.

At the beginning of each test, the engine is conditioned with new valves which are weighed. At the end of the test, the valves are removed, washed with hexane, dried, and then weighed after the physical removal (scraping) of the deposits formed on the valve on the combustion chamber side.

The results presented hereafter give the weight of the deposits measured on the tulip-shaped part of each inlet valve, through the difference between the weight of the new valve and the weight of the valve at the end of each test, after the removal of the deposits on the combustion chamber side. Eleven tests have been carried out from the following fuels:

C1: base fuel alone
C2: base fuel containing 306 ppm by mass of active material of constituent B1
C3: base fuel containing 306 ppm by mass of active material of constituent A2
C4: base fuel containing 306 ppm by mass of active material of constituent B2
C5: base fuel containing 306 ppm by mass of active material of constituent A3
C6: base fuel containing 306 ppm by mass of active material of a mixture of constituent A3 and constituent B1 in a 0.7:1 molar ratio C7: base fuel containing 306 ppm by mass of active material of a mixture of constituent A3 and constituent B1 in a 0.4:1 molar ratio C8: base fuel containing 306 ppm by mass of active material of a mixture of constituent A3 and constituent B2 in a 2:1 molar ratio C9: base fuel containing 306 ppm by mass of active material of a mixture of constituent A2 and constituent B1 in a 0.7:1 molar ratio C10: base fuel containing 306 ppm by mass of active material of a mixture of constituent A2 and constituent B2 in a 0.7:1 molar ratio C11: base fuel containing 306 ppm by mass of active material of a mixture of constituent A4 and constituent B1 in a 0.7:1 molar ratio.

The obtained results are presented in Table II hereafter.

TABLE II

| Fuel | Weight of the deposits (average per valve) |
|---|---|
| C1 | 544 mg |
| C2 | 320 mg |
| C3 | 410 mg |
| C4 | 270 mg |
| C5 | 490 mg |
| C6 | 75 mg |
| C7 | 60 mg |
| C8 | 150 mg |
| C9 | 55 mg |
| C10 | 60 mg |
| C11 | 80 mg |

It can be seen that the utilization of fuels C6 to C11 comprising formulations according to the invention gives a deposit on the valves which is decidedly smaller than that obtained with base fuel C1 and smaller than that obtained with fuels C2 to C5 containing the separate additives (compare for example fuel C6 with fuels C2 and C5).

EXAMPLE 7

The "carburetor" detergency properties of the formulations according to the invention and comparatively of the separate additives are determined.

The engine testing procedure is carried out following the european standard R5-CEC-FO3-T-81. The results are expressed in terms of merit from zero to ten. A 10 merit corresponds to a clean carburetor and a 0 merit, to a very dirty carburetor. The tests are performed from fuels C1 to C10 described in example 6. The obtained results are presented in Table III hereafter.

TABLE III

| Fuel | Merit |
|---|---|
| C1 | 1.9–2.3 |
| C2 | 5.0–5.3 |
| C3 | 7.2–7.4 |
| C4 | 4.9–5.1 |
| C5 | 7.6–7.8 |
| C6 | 8.5–8.8 |
| C7 | 8.4–8.6 |
| C8 | 8.7–8.9 |
| C9 | 8.4–8.6 |
| C10 | 8.3–8.5 |

EXAMPLE 8

The anti-corrosive properties of the formulations according to the invention are determined.

The tests consist in determining the extent of the corrosion produced on ordinary polished steel samples in the presence of synthetic sea-water, following the modified D 665 ASTM standard (temperature 32.2° C., duration 20 hours). The tests are carried out from some of the fuels described in example 6. The obtained results are presented in Table IV hereafter; they are expressed in percentages (%) of the test piece surface which has been corroded after 20 hours.

TABLE IV

| Fuel | % of corroded surface |
|---|---|
| C1 | 100% |
| C2 | 0% |
| C8 | 0% |
| C10 | 0% |

EXAMPLE 9

Solutions of 40% by weight of active material, in the xylene, of formulations F1 to F4, comprising various amounts by weight of polypropyleneglycol (constituent (C)) of the following formula, are prepared:

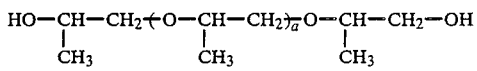

with an average molecular mass of 922 (x=13.6) and a polydispersivity of 1.1. Formulation F1 contains the constituent (A3) described in example 4, the constituent (B1) described in example 1 and the polypropyleneglycol (constituent (C)) described above; the molar ratio of the number of mole of constituent (A3) to the number of mole of constituent (B1) is 0.7:1. The amount of polypropyleneglycol in this formulation is such that the molar ratio of the sum of the number of mole of constituent (A3) and constituent (B1) that it contains to the number of mole of polypropyleneglycol it contains ((A3)+(B1))/(C) is 0.7:1. Formulation F2 contains the constituent (A3) described in example 4, the constituent (B1) described in example 1 and the polypropyleneglycol described above; the molar ratio of the number of mole of constituent (A3) to the number of mole of constituent (B1) is 2:1; the amount of polypropyleneglycol in this formulation is such that the molar ratio of the sum of the number of mole of constituent (A3) and constituent (B1) that it contains to the number of mole of polypropyleneglycol it contains ((A3)+(B1))/(C) is 0.73:1. Formulation F3 comprises the polypropyleneglycol and contains neither constituent (A3) nor constituent (B1). Formulation F4 comprises each constituent (A3) and (B1) in a 2:1 molar ratio and contains no polypropyleneglycol.

EXAMPLES 10 to 14

A series of tests have been carried out to assess the valve detergency properties of various formulations. The tests have been performed on a M102E Mercedes engine bench, without any additive in the case of examples 11 to 14 inclusive. The testing procedure is a conventional procedure comprising the utilization of a 4 cylinder-engine of the M102E Mercedes type, with a piston displacement of 2,299 $cm^3$ and a 9/1 compression ratio. The testing procedure is a cyclic procedure, each cycle comprising four successive running periods:

30 s (seconds) at 800 rpm (revolutions per minute) under a zero load, 60 s at 1,300 rpm under a load of 31 newtons ($m \times kg \times s^{-2}$), 120 s at 1,850 rpm under a load of 34 newtons and 60 s at 3,000 rpm under a load of 37 newtons.

Each test usually lasts 40 to 150 hours; in examples 10 to 14, the test duration was 40 hours. At the beginning of each test, the engine is conditioned with new valves which are weighed. At the end of the test, the valves are removed, washed with hexane, dried, and then weighed after the physical removal (scraping) of the deposits formed on the valve on the combustion chamber side. The results presented hereafter give the average of the deposits by weight in relation to a valve, calculated from the deposit weight measured on the tulip-shaped part of each inlet valve, through the difference between the weight of said new valve and the weight of said valve at the end of each test, after the removal of the deposits on the combustion chamber side. The state of each valve (on the inlet side: tulip-shaped part) is also visually assessed in terms of merit from 1 to 10, according to the procedure which is usually called CRC (Coordinating Research Council) by the person skilled in the art; the results are expressed hereafter in the form of an average per valve; a 10 merit corresponds to a clean valve and a 1 merit, to a very dirty valve. The sticky or non sticky aspect of the deposits formed on the inlet valves on the inlet side is also determined during the removal of the valves. The tendency to sticky deposits might, in the long run, show a tendency to a future valve sticking phenomenon which it would be advisable to avoid.

The fuel which is utilized for these assessments is an unleaded supergasoline comprising 2% by volume of a mixture of methanol and tertiobutanol in a 1.5:1 volume ratio. This supergasoline, of a motor octane number of 85 and a research octane number of 95, has an initial distillation point of 32° C. and an end distillation point of 227° C.; it comprises by volume:

49% of aromatics
11% of olefins
40% of saturated compounds (paraffins+naphthenics).

The formulations are added to the fuel in order to obtain a concentration, by weight of active material in the additive-bearing fuel, which is given for each example in Table V hereafter, including the obtained results.

TABLE V

| Example | Additive amount | Deposits average in mg | CRC average | Deposits aspect |
|---|---|---|---|---|
| 10* | 0 ppm | 239 | 7.7 | |
| 11 | F1 600 ppm | 9 | 9.8 | not sticky |
| 12 | F2 300 ppm | 20 | 9.6 | slightly sticky |
| 13* | F3 600 ppm | 203 | 7.8 | |
| 14* | F4 300 ppm | 98 | 9.0 | sticky |

*comparison

The analysis of the results obtained in examples 10 to 14 shows that the formulations according to the present invention comprising the three constituents (A), (B) and (C) allow to considerably decrease the amounts of deposits on the inlet valves and also to change the aspect of these deposits in comparison to that which they show in the presence of a formulation which does not contain constituent (C).

We claim:

1. An additive composition for engine fuels, comprising a constituent (A) and a constituent (B), said constituent (A) consisting of at least one nitrogen compound resulting from the reaction of an alkenylsuccinic or polyalkenylsuccinic anhydride with an average molecular mass ranging from 200 to 3,000 with at least one polyamine of the general formula:

$$R^1-Z-[-(\overset{R_2}{\overset{|}{C}}H-)_n-NH]_m-H \text{ or} \qquad (I)$$

$$\begin{matrix} R^1 \\ R^3 \end{matrix}\!\!>N-A-(O-B)_a-(O-C)_b-(O-D)_c-NH_2 \qquad (II)$$

in which Z is $-NR^3$ and $R^1$ and $R^3$, identical or different, represent each an atom of hydrogen or a hydrocarbon group with 1 to 30 atoms of carbon, each $R^2$ independently represents an atom of hydrogen or a methyl group, n is an integral number from 2 to 4 and m is an integral number from 1 to 5, A, B, C and D, identical or different, represent each a divalent hydrocarbon group with 2 to 6 atoms of carbon, a is an integral number from 1 to 120, b and c, identical or different, are each zero, or a is an integral number from 1 to 59 and c is zero or an integral number such that a+c is 1 to 59 and b is an integral number from 1 to 50, and the sum a+b+c is an integral number from 1 to 120 and said constituent (B) consisting of at least one nitrogen compound resulting from the reaction of an alkenylsuccinic or a polyalkenylsuccinic anhydride with an average molecular mass ranging from 200 to 3,000 with at least one 1-(2-hydroxyethyl-imidazoline substituted in the 2-position by an alkyl or alkenyl radical, linear or branched, with 1 to 25 atoms of carbon, and wherein the molar ratio of constituent (A) to constituent (B) ranges from 0.2:1 to 5:1.

2. A composition according to claim 1 wherein the polyamine is a polyamine of general formula (I) in which Z is $-NR^3-$ and $R^1$, $R^2$ and $R^3$ represent each an atom of hydrogen, n is 2 and m is an integral number from 1 to 5.

3. A composition according to claim 1 wherein the polyamine of general formula (I) is tetraethylenepentamine.

4. A composition according to claim 1 wherein the polyamine is a polyamine of general formula (I) in which Z is $-NR^3-$ and $R^2$ and $R^3$ represent each an atom of hydrogen, $R^1$ represents a hydrocarbon group with 5 to 24 atoms of carbon, n is 3 and m is 1.

5. A composition according to claim 1 wherein the polyamine is a polyamine of general formula (II) in which $R^1$ and $R^3$ represent each an atom of hydrogen, A, B, C and D, identical or different, represent each a divalent hydrocarbon group with 2 to 4 atoms of carbon and a is an integral number from 1 to 60.

6. A formulation according to claim 1 wherein the substituted imidazoline is selected from the group constituted by the 1-(2-hydroxyethyl)-2-heptadekenylimidazoline and the 1-(2-hydroxyethyl)-2-methylimidazoline.

7. A formulation according to claim 1 characterized in that it also comprises at least one constituent (C) consisting of at least one polyglycol soluble in said fuel, with an average molecular mass ranging from 480 to 2,100 and of general formula (III):

$$HO-R-(-O-R-)_x-O-R-OH \qquad (III)$$

in which each group R independantly represents a hydrocarbon group with 2 to 6 atoms of carbon and x represents the average degree of polymerization.

8. A formulation according to claim 7 wherein constituent (C) is a polyglycol of general formula III in which each group R independantly represents an alkylene group, linear or branched, with 2 to 4 atoms of carbon.

9. A formulation according to claim 7 wherein constituent (C) is a polyglycol of general formula III with a polydispersivity number ranging from about 1 to about 1.25.

10. A composition according to claim 1, wherein the polyamine has the formula $R^1—NH—(CH_2)_3—NH_2$, and $R^1$ is an alkyl cut having the following composition:

$C_{14}$ 2.3%
$C_{16}$ 31.8%
$C_{18}$ 24.2%
$C_{18-1}$ 39%
$C_{20}$ 2.7%, $C_{18-1}$ being an 18-carbon atom molecule having ethylenic unsaturation.

11. A composition according to claim 1, wherein the polyamine has the formula $$NH_2—\underset{}{\overset{CH_2}{\overset{|}{CH}}}—CH_2—(OCH_2—\overset{CH_3}{\overset{|}{CH}})_aNH_2,$$

with an average molecular mass of 400, and a is about 5.5.

12. In a fuel composition comprising (a) a detergent additive and (b) a mixture of hydrocarbons or (c) a mixture of hydrocarbons and at least one oxygen compound selected from the group consisting of alcohols and ethers, the improvement wherein the detergent additive is a composition of claim 1.

13. A composition according to claim 12, wherein the additive is present in an amount of 10 to 3000 ppm by weight in the fuel composition.

14. In a combustion process comprising burning a fuel composition in a spark ignition engine, the improvement wherein the fuel composition is a composition of claim 12.

* * * * *